US006655815B1

(12) United States Patent
Sools et al.

(10) Patent No.: US 6,655,815 B1
(45) Date of Patent: Dec. 2, 2003

(54) LUMINAIRE

(75) Inventors: Franciscus Guillaume Peter Sools, Eindhoven (NL); Mark Fierloos, Eindhoven (NL); Norbert Dicken, Buettgen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/711,728

(22) Filed: Nov. 13, 2000

(30) Foreign Application Priority Data

Nov. 18, 1999 (EP) ..... 99203849

(51) Int. Cl.[7] ..... F21S 4/00

(52) U.S. Cl. ..... 362/217; 362/224; 362/367; 40/564

(58) Field of Search ..... 362/223, 224, 362/812, 367, 368, 217; 40/575, 605, 564

(56) References Cited

U.S. PATENT DOCUMENTS

| | | | | | |
|---|---|---|---|---|---|
| 3,760,178 A | | 9/1973 | Miller | 240/106 |
| 4,464,708 A | | 8/1984 | Nussli et al. | 362/300 |
| 4,631,647 A | | 12/1986 | Ranney | 362/147 |
| 5,446,634 A | * | 8/1995 | Okubo | 362/147 |
| 5,645,337 A | * | 7/1997 | Gleckman | 313/113 |
| 5,682,694 A | * | 11/1997 | Hillstrom | 312/139 |
| 6,042,243 A | * | 3/2000 | Grill et al. | 362/125 |
| 6,282,821 B1 | * | 9/2001 | Freier et al. | 359/599 |
| 6,508,171 B1 | * | 1/2003 | Georges | 101/483 |

* cited by examiner

*Primary Examiner*—Sandra O'Shea
*Assistant Examiner*—John Anthony Ward
(74) *Attorney, Agent, or Firm*—Frank Keegan

(57) ABSTRACT

A system of a first luminaire (1) and a second luminaire (11) for lighting an object (V). Each luminaire has a housing (2; 12) provided with a plurality of tubular lamps (3, 3', 3 "; 13). The housing (2; 12) has a light emission window (4; 14) and a side wall (5, 5'; 15) which is perpendicular to the light emission window (4; 14). In the system, the first and the second luminaire (1; 11) abut one another with their side walls (5, 5'; 15) and/or with their light emission windows (4; 14), such that an edge (6) of the light emission window (4) of the first luminaire (1) abuts an edge (16) of the light emission window (14) of the second luminaire (11). Said light emission windows (4; 14) and said side walls (5, 5'; 15) are made from an optically transparent material. Preferably, the light emission window (4; 14) is provided with a diffusor (7; 17). Preferably, said diffusor (7; 17) exhibits a variation in layer thickness, the layer thickness being greater at a location on the light emission window (4; 14) close to the tubular lamps (3, 3', 3"; 13) than at a further distance from the tubular lamps (3, 3', 3"; 13). The object (V) is homogeneously and uniformly illuminated by said system.

29 Claims, 1 Drawing Sheet

LUMINAIRE

FIELD OF THE INVENTION

The invention relates to a system of a first luminaire and a second luminaire for illuminating an object.

The invention further relates to a luminaire for use in said system.

The invention further relates to a method of presenting and/or selling an object.

BACKGROUND OF THE INVENTION

Such a system and such a luminaire are known per se. They are used inter alia in ceiling lighting and for illuminating objects such as, for example, objects in a shop window, in a shop, in an exhibition space, for example for the illumination of art objects, or in a showroom, for example for the illumination of comparatively large objects, for example vehicles. Such a system or luminaire is further used for wall illumination so as to illuminate objects from the side, or as floor illumination, for example on theatrical stages, for the illumination of objects or persons. Said system and luminaire are further used as backlights for, for example, (picture) display devices such as, for example, (PA)LC displays or video walls, and as office lighting, or as a luminaire for enhancing the appearance of an object. Usually, a system as mentioned in the opening paragraph comprises a plurality of luminaires mounted next to one another, often as a number of coupled squares.

A luminaire of the type mentioned above has a major disadvantage. The luminaire has a surface with a non-homogeneous light distribution. The object is not evenly lit as a result, which is undesirable. In addition, the system of a first luminaire and a second luminaire comprises a comparatively wide band between the luminaires which is comparatively dark.

SUMMARY OF THE INVENTION

The invention has for its object to counteract the above disadvantage.

According to the invention, this object is achieved with a system of a first luminaire and a second luminaire for illuminating an object, wherein the first and the second luminaire each comprise a housing for accommodating at least one tubular lamp, which housing is provided with a light emission window for illuminating the object and a side wall which is transverse to the light emission window, wherein the first luminaire abuts the second luminaire by its side wall and/or by its light emission window, wherein an edge of the light emission window of the first luminaire abuts an edge of the light emission window of the second luminaire in the system of the first and the second luminaire, and wherein said light emission windows and said side wall are manufactured from an optically transparent material.

It was found that the two light emission windows in the system form a homogeneously illuminated plane during lamp operation. The expression "homogeneously illuminated" in the present invention is understood to mean that the light emission window has a light distribution over the surface of the light emission window which exhibits differences in intensity which are not or substantially not observable to the human eye during operation. The expression "homogeneously illuminated" applied to the system further means that especially the edges of the respective light emission windows and transitions between mutually adjoining luminaires exhibit differences in light intensity from the light emitted by the relevant light emission window as a whole which are not or substantially not perceivable. In other words, the light output of a light emission window including its edge has a dependence on the position in the light emission window which is not or substantially not observable.

Light emitted during operation by the tubular lamps reaches the light emission window of the luminaire and is emitted from there in the direction of the object. Such a luminaire usually comprises a plurality of tubular lamps, for example low-pressure mercury vapor discharge lamps. These light sources are usually provided in a certain regular distribution in the housing, the tubular lamps being arranged, for example, parallel to one another. To reduce a direct visibility of the tubular lamps in the housing, each of the housings of the luminaires is provided with an optically transparent light emission window manufactured, for example, from a glass or a synthetic resin which preferably scatters the light diffusely. The system is built up such that the light emission windows of mutually adjoining luminaires touch one another or at least substantially touch one another, so that a comparatively wide, comparatively dark band at the area of the abutting luminaires, as in the known system, is avoided. Since the side wall of the luminaire is manufactured from an optically transparent material, light emitted during operation by the tubular lamps is partly caught by this side wall, which absorbed light is transported by means of internal reflections in the direction of the light emission window, where it is emitted again. This achieves that the edge of the light emission window of the first luminaire has a luminance which is at least substantially equal to that of the rest of the light emission window. Given two or more luminaires which abut one another at the area of the edges of the light emission windows of the respective luminaires, a light emission window is thus obtained which is homogeneously illuminated up to and including the edge of the light emission window during operation, so that the system emits a homogeneous light. An observer will be incapable or substantially incapable of distinguishing the edges of the light emission windows of the respective luminaires on the basis of the light distribution as emitted by the system during operation.

In the known system of luminaires, the luminaires usually do not abut, so that a comparatively wide and dark band is present between the luminaires and is observed as such. These bands achieve that the known system has a checkered appearance and that in addition the object is not homogeneously illuminated. Since the object is integrally and homogeneously illuminated owing to the measure according to the invention, an observer's attention is not drawn from the object by irregularities in the illumination of the object. The use of the system according to the invention renders it possible to illuminate objects very homogeneously and uniformly. This has particular advantages for viewing, for example, art objects in museums, or motor vehicles, for example in dealer showrooms. Particularly in the case of objects which have reflecting properties, and preferably objects having specular reflection, the absence of visible edges in a reflection of the system on the object is perceived as an advantage by a viewer. The measure according to the invention enhances the attractiveness of objects which are presented, for example, with the aim of selling the objects.

An embodiment of the system according to the invention is characterized in that the light emission window of the respective luminaire is provided with a diffusor. A diffusor achieves that the uniformity of the light intensity distribution of the light emitted by the light emission window during operation is further enhanced. A combination of a light emission window made from a material which emits the light diffusely and a diffusor provided on the light emission window renders it possible to position the tubular lamps closer to the light emission window, so that the dimensions of the luminaire will be considerably more compact than those of the known luminaire, while nevertheless a more homogeneous light distribution is realized than with the known luminaire. It is in particular possible as a result of this to reduce the depth of the housing, which is a major advantage in mounting of the system.

The inventors have come to recognize that multiple reflections in the luminaire, especially caused in the diffusor, contribute to a very homogeneous distribution of the intensity of the light emerging from the light emission window. Preferably, the diffusor has a variation in layer thickness, the layer thickness of the diffusor being chosen to be greater immediately opposite the location where the tubular lamp is present during operation than at a further distance from the lamp. A diffusor which is comparatively thick in locations on the light emission window close to the tubular lamp and comparatively thin in locations on the light emission window comparatively far removed from the tubular lamp or lamps achieves that the uniformity of the light intensity distribution of the light emitted by the light emission window during operation is further improved. The provision of a diffusor with said layer thickness variation on the light emission window of a luminaire renders it possible to position the tubular lamps still closer to the light emission window, so that the dimensions of the luminaire are more compact than those of the known luminaire, while nevertheless a more homogeneous light distribution is realized than with the known luminaire. This renders it possible to reduce the depth of the housing considerably, which is a major advantage in mounting of the system.

Preferably, the transmission of the diffusor at the area where the layer thickness is greatest is approximately 50% of the transmission of the diffusor at the area where the layer thickness is smallest. In other words, the transmission of the diffusor on the light emission window immediately opposite the location where the tubular lamp is present is approximately 50% of the transmission of the diffusor at the area of the light emission window where the tubular lamp is at a maximum distance from the light emission window during operation. Particularly suitable materials for the diffusor are calcium halophosphate and/or calcium pyrophosphate. Such a diffusor is preferably provided as a paint to which a binder, for example a fluorine copolymer, is added.

BRIEF DESCRIPTION OF THE DRAWING

The invention will now be described in more detail with reference to a number of embodiments and a drawing, in which.

Figure 1:
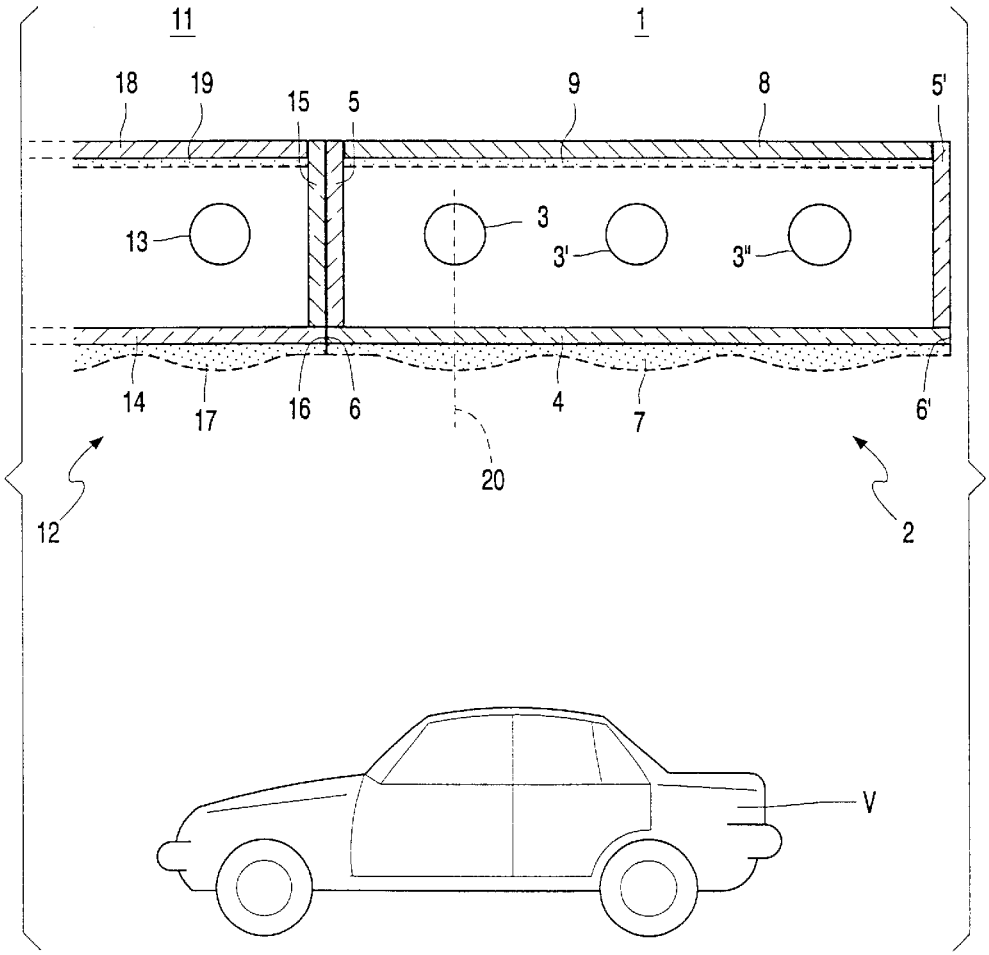
FIG. 1 shows an example of a system of two luminaires according to the invention in cross-section.

The FIGURE is purely diagrammatic and not drawn true to scale. Some dimensions have been particularly exaggerated for greater clarity.

DETAILED DESCRIPTION OF THE PREFERRED EMBODIMENTS

FIG. 1 shows a system of a first luminaire 1 and a second luminaire 11 for illuminating an object V. The object V in FIG. 1 is a vehicle, for example an automobile. Alternative objects are art objects, for example paintings, photographs, sculptures, etc. Such objects often have a mirroring appearance.

The first and the second luminaire 1; 11 each comprise a box-shaped housing 2; 12. A plurality of tubular lamps 3, 3', 3"; 13 is provided in the housing 2; 12, for example low-pressure mercury vapor discharge lamps. In the example of FIG. 1, the luminaire 1 accommodates three TL5 discharge lamps. In an alternative embodiment, five, eight, or more lamps are provided in one luminaire, for example of the TL528 W type with color rendering index 84. The tubular lamps 3, 3', 3"; 13 are provided in a certain regular distribution in the housing 2; 12, such that the tubular lamps 3, 3', 3"; 13 are arranged mutually in parallel. Preferably, the distance between the side wall 5; 15 and the lamp 3; 13 placed closest to said side wall 5; 15 is at least substantially half the mutual interspacing between the respective lamps 3, 3', 3".

To reduce a direct view of the tubular lamps 3, 3', 3"; 13 in the housing 2; 12 and to achieve a homogeneous light output, each of the housings 2; 12 of the luminaires 1; 11 is provided with an optically transparent light emission window 4; 14 for illuminating the object. The housing is provided with a side wall 5, 5'; 15 transverse to the light emission window 4; 14. If so desired, the side wall 5, 5'; 15 may also be provided obliquely with respect to the light emission window 4; 14. The light emission window 4; 14 and the side wall 5, 5'; 15 are manufactured, for example, from a glass, a synthetic resin, or Perspex which scatters the light, preferably diffusely (for example so-called milk-glass).

In the system according to the invention, the first luminaire 1 abuts against the second luminaire 11 by a side wall 5, 5'; 15. In an alternative embodiment, the luminaires 1; 11 in the system abut by their light emission windows 4; 14. In that case, the side walls support the light emission window not at the edges of the light emission window, but for example, at some (short) distance from the edges of the light emission window. In a further alternative embodiment of the system, the light emission window is interrupted at the area of the side wall. In that case, the edge of the side wall is considered to form part of the light emission window in the description of this invention.

In the example of FIG. 1, both the housing 2 of the first luminaire 1 and the housing 12 of the second luminaire 11 are provided with a side wall, referenced 5 and 15, respectively, at the area where the luminaires 1; 11 abut. The invention, however, is not limited to this embodiment. Thus only one side wall may be present at the area of the abutting luminaires, in which case, for example, the side wall of the one luminaire supports the light emission windows of both luminaires. Such an embodiment may simplify the assembly of luminaires in forming the system. In the system according to the invention, an edge 6, 6' of the light emission window 4 of the first luminaire 1 at the area of the side wall 5, 5' abuts against an edge 16 of the light emission window 14 of the second luminaire 11 at the area of the side wall 15. Furthermore, the light emission windows 4; 14 and said side wall 5, 5', 15 are manufactured from an optically transparent material. Given such a system, the two light emission windows 4; 14 form a homogeneously illuminated surface.

In the example of FIG. 1, the light emission window 4; 14 is further provided with a diffusor 7; 17 which is provided on an outside of the housing 2; 12 on the light emission window 4; 14. In an alternative embodiment, the diffusor is provided on the side of the light emission window facing towards the lamp(s). In particular, the diffusor 7; 17 has a layer thickness variation, the layer thickness of the diffusor 7; 17 being chosen to be greater immediately opposite the location where the tubular lamp 3, 3', 3"; 13 is present during operation. A longitudinal axis 20 transverse to the light emission window 4 is drawn in FIG. 1, extending through the center of the tubular lamp 3 and indicating the thickest region of the diffusor layer.

The provision of a diffusor 7; 17 with said layer thickness variation on the light emission window of the luminaire 1; 11 renders it possible to position the tubular lamp 3, 3', 3"; 13 comparatively closely to the light emission window 4; 14 in the housing 2; 12, so that the dimensions of the luminaire 1; 11 are more compact than those of the known luminaire, while nevertheless a more homogeneous light distribution is realized than with the known luminaire. It is rendered possible in particular thereby to reduce the depth of the housing 2; 12 considerably, which is a major advantage in mounting of the system.

The housing 2; 12 of the luminaire 1; 11 in the system is preferably rectangular, for example square with typical dimensions of 300 mm, 600 mm, 900 mm, 1200 mm, or 1500 mm, or combinations thereof. The height of the housing 2; 12 can be comparatively small thanks to the measure according to the invention. Very suitable is a height of 30 to 70 mm for the housing 2; 12, in particular a height of 35 mm. No special recessed plates need be used for ceiling mounting thanks to the possibility of a very compact construction. In fact, the luminaires are provided with interspacings equal to zero and form as it were an integral whole in the system. The components necessary for mounting are invisible. It is possible for maintenance purposes to remove the light emission window 2; 12 provided with the diffusor 7; 17 from the housing parallel to the longitudinal axis 20, for example for the replacement of the tubular lamps.

Preferably, the transmission of the diffusor 7; 17 at the area where the layer thickness is greatest is approximately 50% of the transmission of the diffusor 7; 17 at the area where the layer thickness is smallest. In other words, the transmission of the diffusor 7; 17 on the light emission window 4; 14 immediately opposite the location where the tubular lamp 3, 3', 3"; 13 is present is approximately 50% of the transmission of the diffusor 7; 17 at the area of the light emission window 4; 14 where the tubular lamp 3, 3', 3"; 13 is at a maximum distance from the light emission window 4; 14 during operation. Particularly suitable materials for the diffusor 7; 17 are calcium halophosphate and/or calcium pyrophosphate. Such a diffusor is provided in the form of a paint in which a binder, for example a fluorine copolymer, for example THV, is used, as well as a solvent (for example Mibk). The advantages of the use of such a diffusor 7; 17 and of such a binder in the diffusor 7; 17 are that baking is not necessary, and that the reflection over the entire visible range and a major portion of the UV range has at least substantially the same high value. This means that this diffusor 7; 17 and these binders are particularly suitable for use in coating layers on which the light is reflected many times, because preferential absorption and resulting color differences are effectively counteracted thereby. Furthermore, other additives may have been added to the paint mixture, for example those which have improved flowing or mixing characteristics.

The light absorption of visible light of such a diffusor 7; 17 is very low, i.e. less than 3%. This renders it possible to create a large lamp distance/diffusor thickness ratio without the efficiency of the luminaire being adversely affected. In addition, a diffusor 7; 17 comprising calcium halophosphate and/or calcium pyrophosphate has substantially no color shift, i.e. such a diffusor has a comparatively low wavelength dependence.

In the example of FIG. 1, the housing 2; 12 is further provided with a rear wall 8; 18 which is provided with a reflecting coating 9; 19, which is known per se, on a side which faces the light emission window 4; 14.

It will be obvious that many variations are possible to those skilled in the art within the scope of the invention.

The scope of protection of the invention is not limited to the embodiments described. The invention resides in each new characteristic and each combination of characteristics. Reference numerals in the claims do not limit the protection scope thereof. The use of the verb "comprise" does not exclude the presence of elements other than those mentioned in the claims.

What is claimed is:

1. A system of a first luminaire and a second luminaire for illuminating an object, wherein the first and the second luminaire each comprise a housing for accommodating at least one lamp, each said housing being provided with a light emission window for illuminating the object and a side wall which is transverse to the light emission window, wherein the first luminaire abuts the second luminaire by its side wall or by the light emission window, wherein an edge of the light emission window of the first luminaire abuts an edge of the light emission window of the second luminaire in the system of the first and the second luminaire, and wherein said light emission windows and said side wall are optically transparent.

2. A system as claimed in claim 1, wherein the light emission window is provided with a diffusor.

3. A system as claimed in claim 2, wherein the diffusor has a layer thickness variation, such that the layer thickness of the diffusor is chosen to be greater immediately opposite the location where the lamp is present during operation than at a further distance from said lamp.

4. A system as claimed in claim 3, wherein the transmission of the diffusor at the area where the layer thickness is greatest is approximately 50% of the transmission of the diffusor at the area where the layer thickness is smallest.

5. A system as claimed in claim 2, wherein the material of the diffusor is chosen from a group formed by calcium halophosphate and calcium pyrophosphate.

6. A system as claimed in claim 2, wherein the diffusor comprises a fluorine copolymer as a binder.

7. A system as claimed in claim 1, wherein the housing further comprises a rear wall, and wherein said rear wall is provided with a reflecting coating at a side which faces the light emission window.

8. A luminaire suitable for use in a system as claimed in claim 1.

9. A system as claimed in claim 1 wherein the side wall of the first luminaire and the side wall of the second luminaire are the same side wall.

10. A system as claimed in claim 1, wherein the edge of the light emission window of the first luminaire has a luminance which is at least substantially equal to that of the rest of the light emission window of the first luminaire so that a reflection of said edge on the object is not visible.

11. A method of presenting an object comprising:

positioning the object to receive light from a first luminaire and a second luminaire, and illuminating the object with light from said first luminaire and said second luminaire, the first and the second luminaire each comprising a housing for accommodating at least one lamp, each said housing being provided with a light emission window and a side wall which is transverse to the light emission window, the first luminaire abutting the second luminaire by at least the respective light emission windows, an edge of the light emission window of the first luminaire abutting an edge of the light emission window of the second luminaire, and said light emission windows and said side wall being optically transparent.

12. A method as claimed in claim 11, wherein the object exhibits specular reflection.

13. A method as claimed in claim 12, wherein the object comprises a vehicle or an art object.

14. A lighting system comprising a first luminaire and a second luminaire, the first luminaire having a first housing and the second luminaire having a second housing, each said housing accommodating, respectively, at least one first luminaire lamp and at least one second luminaire lamp, said first housing being provided with a translucent first light emission window with at least one edge and a translucent first side wall transverse to the light emission window, said second housing being provided with a translucent second light emission window with at least one edge and a translucent second side wall transverse to the light emission window, the first and second luminaires abutting each other by said first and second side walls, wherein at least the first light emission window is provided with a diffusor, and wherein the diffusor has a layer thickness variation, such that the layer thickness of the diffusor is chosen to be greater immediately opposite the first luminaire lamp than at a further distance from said first luminaire lamp.

15. A system as claimed in claim 14, wherein the transmission of the diffusor at the area where the layer thickness is greatest is approximately 50% of the transmission of the diffusor at the area where the layer thickness is smallest.

16. A system as claimed in claim 14, wherein the diffusor comprises a material chosen from the group consisting of calcium halophosphate and calcium pyrophosphate.

17. A system as claimed in claim 14, wherein the diffusor is a paint which comprises a fluorine copolymer as a binder.

18. A system as claimed in claim 14, wherein the housing further comprises a rear wall, and wherein said rear wall is provided with a reflecting coating at a side which faces the light emission window.

19. A system as claimed in claim 14, wherein the edge of the light emission window of the first luminaire has a luminance which is at least substantially equal to that of the rest of the light emission window of the first luminaire so that a reflection of said edge on the object is not visible.

20. A luminaire suitable for use in a system as claimed in claim 14.

21. A lighting system comprising a first luminaire and a second luminaire, the first and the second luminaire each having a housing, each said housing accommodating at least one lamp, each said housing being provided with an optically transparent light emission window with at least one edge, and the first and second luminaires abutting each other by said edges, wherein the light emission window is provided with a diffusor.

22. A system as claimed in claim 21, wherein the diffusor has a layer thickness variation, such that the layer thickness of the diffusor is chosen to be greater immediately opposite the lamp than at a further distance from said lamp.

23. A system as claimed in claim 22, wherein the transmission of the diffusor at the area where the layer thickness is greatest is approximately 50% of the transmission of the diffusor at the area where the layer thickness is smallest.

24. A system as claimed in claim 21, wherein the diffusor comprises a material chosen from the group consisting of calcium halophosphate and calcium pyrophosphate.

25. A system as claimed in claim 21, wherein the diffusor is a paint which comprises a fluorine copolymer as a binder.

26. A lighting system comprising: a first luminaire and a second luminaire, the first luminaire having a first luminaire housing accommodating at least one first luminaire lamp, said first luminaire housing being provided with an optically transparent first light emission window with at least one first edge, the second luminaire having a second luminaire housing accommodating at least one second luminaire lamp, said second luminaire housing being provided with an optically transparent second light emission window with at least one second edge, the first and second luminaires abutting each other by said first and second edges, the first light emission window being provided with a first diffusor layer on a side of the first light emission window facing away from the at least one first luminaire lamp, and the second light emission window being provided with a second diffusor layer on a side of the second light emission window facing away from the at least one second luminaire lamp.

27. A system as claimed in claim 26, wherein the first diffusor layer has a thickness which is greater immediately opposite the at least one first luminaire lamp than at a further distance from the at least one first luminaire lamp.

28. A system as claimed in claim 27, wherein the second diffusor layer has a thickness which is greater immediately opposite the at least one second luminaire lamp than at a further distance from the at least one second luminaire lamp.

29. A system as claimed in claim 27, wherein the transmission of the first diffusor layer at the area where the thickness of the first diffusor layer is greatest is approximately 50% the transmission of the first diffusor layer at the area where the thickness of the first diffusor layer is smallest.

* * * * *